US006227657B1

(12) United States Patent
Raisanen et al.

(10) Patent No.: US 6,227,657 B1
(45) Date of Patent: May 8, 2001

(54) LOW TOPOGRAPHY THERMAL INKJET DROP EJECTOR STRUCTURE

(75) Inventors: Alan D. Raisanen, Sodus; Cathie J. Burke, Rochester; Eduardo Mariano Freire, Webster; Yonglin Xie, Webster; Dale R. Ims, Webster; Michael P. O'Horo, Fairport; Scott C. Warner, Ontario; Thomas A. Tellier, Wolcott; Scott N. Seabridge, Penfield; William G. Hawkins, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/597,282

(22) Filed: Jun. 19, 2000

(51) Int. Cl.[7] ..... B41J 2/05
(52) U.S. Cl. ..... 347/58; 347/63
(58) Field of Search ..... 347/58, 59, 62, 347/63, 64; 257/207, 210, 211, 698, 691, 664, 784

(56) References Cited

U.S. PATENT DOCUMENTS

| | | | | |
|---|---|---|---|---|
| 4,445,266 | * | 5/1984 | Mai et al. | 438/238 |
| 4,742,019 | * | 5/1988 | Bechade | 438/587 |
| 4,887,098 | * | 12/1989 | Hawkins et al. | 347/58 |
| 5,257,042 | * | 10/1993 | Buhler | 347/64 |
| 5,534,901 | * | 7/1996 | Drake | 347/63 |
| 5,988,797 | * | 11/1999 | Itoh | 347/62 |

* cited by examiner

*Primary Examiner*—John Barlow
*Assistant Examiner*—Blaise L. Mouttet
(74) *Attorney, Agent, or Firm*—Oliff & Berridge, PLC

(57) ABSTRACT

The systems and methods of this invention allows for an electrical contact structure of the drop ejecting transducer in an inkjet printhead to be designed in such a way that the relatively thick electrical contact lines are not in the ink drop ejection path between the drop ejector transducer and the corresponding nozzle. Such a design thereby minimizes any visible defects due to misdirected satellite drops.

20 Claims, 4 Drawing Sheets

LOW TOPOGRAPHY THERMAL INKJET DROP EJECTOR STRUCTURE

BACKGROUND OF THE INVENTION

1. Field of Invention

This invention relates generally to the mechanical and electrical structure of the thermal inkjet drop ejectors.

2. Description of Related Art

A conventional thermal inkjet transducer array is essentially a large bank of thin-film resistive heaters electrically connected in parallel. In particular, a thermal inkjet printer comprises an array of drop ejectors. Each drop ejector has an ink channel having an inlet end and a nozzle end and contains a resistive heater. The nozzle end of each resistive heater in the array of drop ejectors is connected to a common electrical bus, which in turn is connected to an electrical power supply providing a printer operating voltage. Each individual drop ejector is driven to eject a droplet of ink by grounding an inlet end of the resistive heater through an individually-addressable driver transistor.

The common electrical bus should be narrow, so that the length of the ink nozzle can be kept as short as possible. This tends to increase drop ejection energy efficiency. To reduce the electrical series resistance of the common bus, it is desirable to make the common bus relatively thick. Often, the common bus will have two or more layers of metal and/or polysilicon.

SUMMARY OF THE INVENTION

However, this thick bus structure presents a "bump"-shaped obstacle in the nozzle that misdirects the ejected main drop and/or associated satellite droplets that are ejected with the main drop. The misdirected satellite drops tend to limit the print quality achievable with drop ejectors having this bump-shaped obstacle. Unfortunately, no reasonable alternative to these drop ejectors was previously available.

This invention provides an electrical contact structure that connects the resistive heaters of the drop ejectors to the common bus that avoid the bump-shaped mechanical structure of the conventional electrical contact structure.

This invention separately provides a mechanical structure for the electrical contact structure between the common bus and the resistive heater that avoids placing relatively thick electrical contact layers in an ink drop ejection path between the resistive heater of the drop ejector and the nozzle of that drop ejector.

This invention separately provides a low-topography inkjet printhead drop ejector array that avoids a large common bus structure in the front of the drop ejectors.

This invention separately provides a low-topography inkjet printhead drop ejector array that locates individual electrical feed-through lines between each drop ejector in the array.

This invention separately provides an inkjet printhead drop ejector array that reduces visible defects due to misdirected satellite drops.

This invention separately provides inkjet printhead drop ejector arrays that relocates the thick electrical contact lines from the ink drop ejection path between the drop ejector resistive heater and the corresponding nozzle.

In various exemplary embodiments of a thermal inkjet printhead according to this invention, the high-current common bus does not extend in front of the row of resistive heaters in the array of drop ejectors. Instead, a flat layer of highly-doped polysilicon forms the common bus. This flat, highly-doped polysilicon layer runs between the resistive heaters and is routed to interconnection pads for each ink drop ejector without placing a bump in the path of an exiting ink droplet.

In various exemplary embodiments, a floor of the ink channel is left more or less flat at the level of the resistive heater. A layer of passivation material, such as, for example, silicon nitride, can be added to the nozzle region of the ink channel to reduce any residual topography. By making the floor of the ink channel more or less coplanar from an inlet end of the resistive heater through the nozzle and out to the front face of the printhead, the topographic features that contribute to misdirecting main drops and/or creating satellite drops are reduced.

These and other features and advantages of this invention are described in, or are apparent from, the following detailed description of various exemplary embodiments of the low-topography inkjet printhead drop ejectors according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
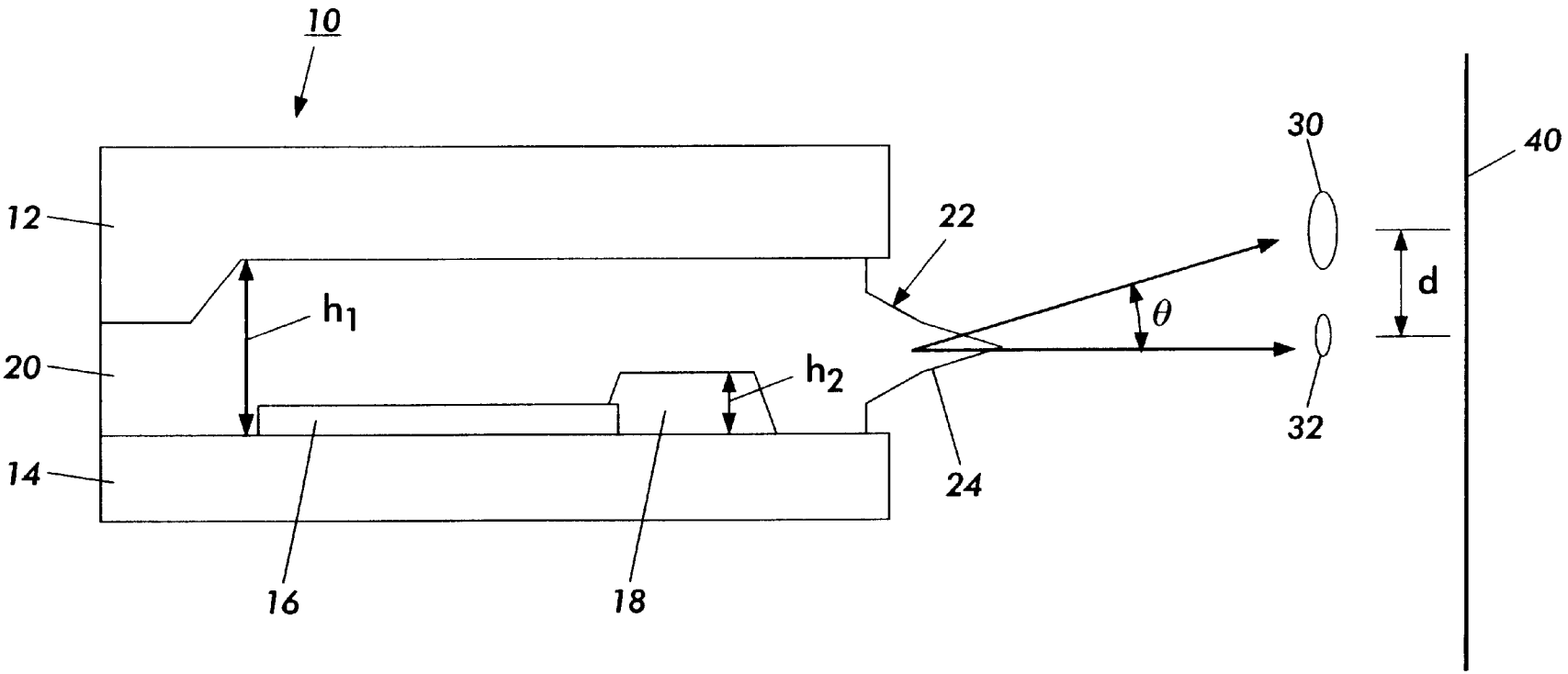
FIG. 1 PRIOR ART
FIG. 1 illustrates the effect of ink channel topography on ink drop formation.

FIG. 1 illustrates the effect on ink drop formation caused by the nozzle topography of a conventional inkjet printhead drop ejector that has the conventional bump-shaped common bus connection structure discussed above. As shown in FIG. 1, the conventional inkjet printhead drop ejector 10 includes a channel plate 12 and a heater plate 14. The channel and heater plates 12 and 14 combine with a polymer spacer layer (not shown) to form an ink channel 20 extending laterally between the channel plate 12 and the heater plate 14. A polysilicon resistive heater 16 is formed on or over the heater plate 14. The common bus connection structure 18 connects the polysilicon resistive heater 16 to a high-voltage power supply. In particular, in conventional thermal inkjet printers, the high-voltage power supply is usually in the range of approximately 40 volts.

When the circuit including the polysilicon resistive heater 16 and the connection structure 18 is closed, current flows through the connection structure 18 and the polysilicon resistive heater 16, causing resistive heating. This resistive heating pumps thermal energy into the ink contained within the ink channel 20. Eventually, a portion of the ink in the ink channel 20 vaporizes, forcing ink past the bump 18 and through a nozzle 22. A top of the nozzle 22 is defined by the channel plate 12, while a bottom of the nozzle 22 is defined by the heater plate 14, and the sides of he nozzle 22 are defined by the polymer spacer layer. In particular, the nozzle 22 is on the other side of the connection structure 18 from the polysilicon resistive heater 16. Thus, the bump-shaped connection structure 18 tends to act as a flow-restriction-like member in the ink channel 20.

The bubble formed in the ink channel 20 causes a portion of the ink 24 to extend out of the nozzle 22. In particular, the force applied by the bubble on the incompressible ink 24 causes a main drop 30 to be ejected from the nozzle 22. However, due to the shape and position of the bump-shaped connection structure 18, one or both of two disadvantageous effects can occur as the main drop 32 is ejected from the ink channel 20.

First, the main drop 32 can be misdirected (as shown by drop 30) as it is ejected out of the inkjet nozzle 22. That is, the main drop 32 ideally exits the ink channel 20 in a direction that is perpendicular to the surface of the recording medium 40 at which the ink drop 32 is ejected. However, due to the bump-shaped connection structure 18, the main drop 32 exits the ink channel 20 at an angle (as shown by drop 30) to the desired direction, reducing the accuracy of ink spot placement on the recording medium 40 from the desired location by a distance "d".

Secondly, the bump-shaped connection structure 18 can cause disturbances in the flow of the ink as it exits the nozzle 22. When the main drop 30 is ejected from the nozzle 22, one or more small satellite drops 30 are generated which also impact the recording medium 40. This disturbance causes one or more satellite drops 30 to depart from the trajectory of the main drop 32 as the ink is ejected from the nozzle 22. In particular, the satellite drops 30 will be ejected at an angle 0 divergent relative to the main drop 32.

Thus, the topography of the ink channel 20 created by the bump-shaped connection structure 18 induces one or more print defects in the images formed by the inkjet printer. As described above, these print defects are related to departures from the ideal flight path of the main drop 32 and differences in the flight paths between the main drop 32 and any satellite drops 30 that may have been ejected with the main drop 32. These defects cause the resulting printed images to be fuzzy, to have elongated spot aspect ratios, to have banding, and/or to have spot width variations. For example, if the inkjet printer forms images by printing swaths in both a forward and a return direction, the motion vector of the printhead will alternately additively or subtractively add to the flight path vectors of the satellite drops, causing the satellite drops to alternatively extend outside of, or fall within, the main drop as it lands on the recording medium 40. Thus, depending on which way the printhead carriage moves relative to the recording medium 40, the size of the spot formed by the combination of the main drop 30 and any satellite drops 32 will change.

Figure 2:
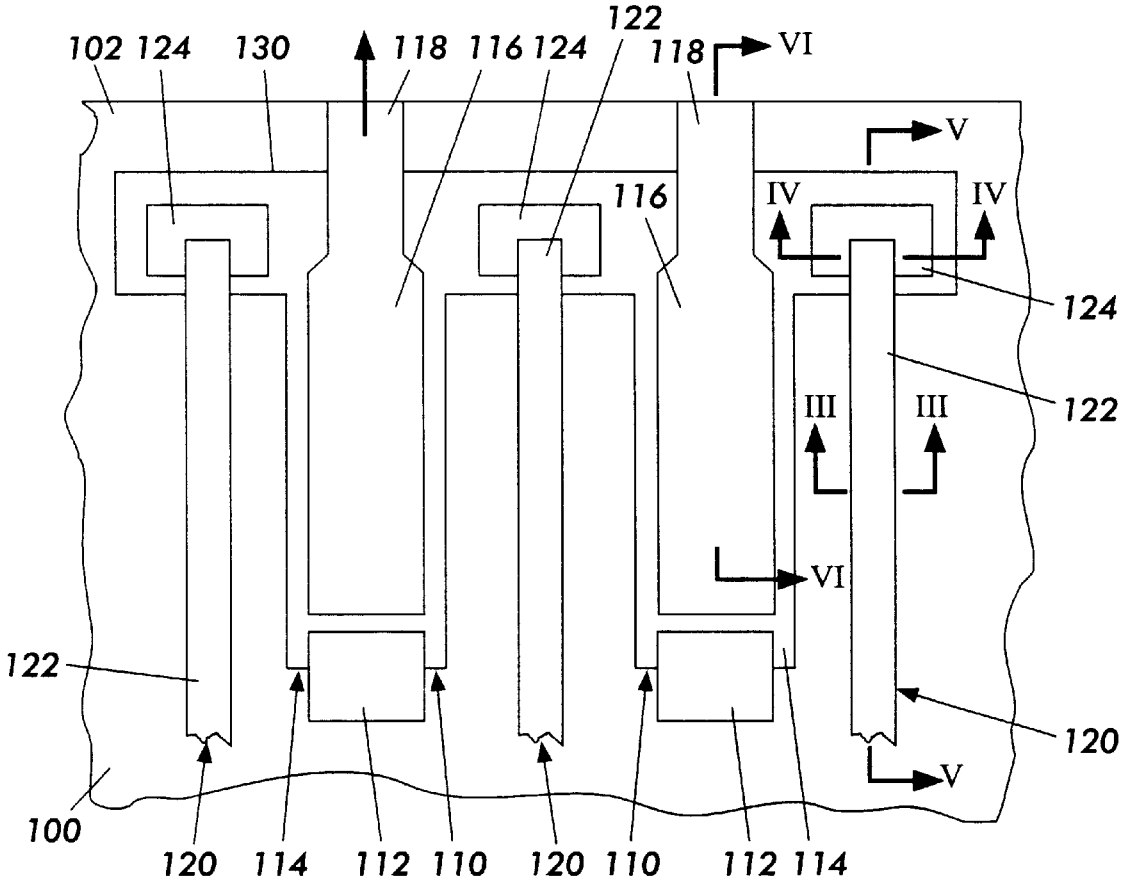
FIG. 2 shows one exemplary embodiment of a low-topography inkjet printhead structure according to this invention.

FIG. 2 is a top plane view of one exemplary embodiment of a low-topography inkjet printhead structure 100 according to this invention. In particular, FIG. 2 shows a top plane view of the heater plate 102 of the low-topography inkjet printhead structure 100 according to this invention. As shown in FIG. 2, a plurality of ejector structures 110 is interleaved with a plurality of common bus connection portions 120. Each of the ejector structures 110 includes an address line connection portion 112 that connects that ejector structure 110 to a high-voltage driver transistor that selectively connects and disconnects the ejector structure 110 to ground. The address line connection portion 112 is located at an inlet end of a resistive heater 114. A polymer nozzle structure 116 is formed over the resistive heater 114 and ends in a nozzle 118.

It should be appreciated that, as outlined below, the resistive heater 114 can be formed by a layer of doped polysilicon. However, it should also be appreciated that the resistive heater 114 can also be formed using a thin-film resistor in place of the doped polysilicon layer within the ink channel 20. It should further be appreciated that the thin-film resistor can be formed using any appropriate process, such as, for example, sputtering.

Each of the common bus connection structures 120 forms a connection structure 124 that connects a common bus portion 130 to a drive voltage bus that is held at the drive voltage. In general, for most common thermal inkjet printers, the drive voltage is 40 volts. The common bus portion 130 extends across a front portion of the heater plate 102 and connects to each of the resistive heaters 114. In the exemplary embodiment shown in FIG. 2, the common bus connection portion 120 connects to the drive voltage bus at a location behind the ejector structures 1 relative to the nozzles 118. In particular, the common bus connection portion 120 includes a linear connection portion 122 connected to the common bus 130 through the connection structure 124.

Figure 3:
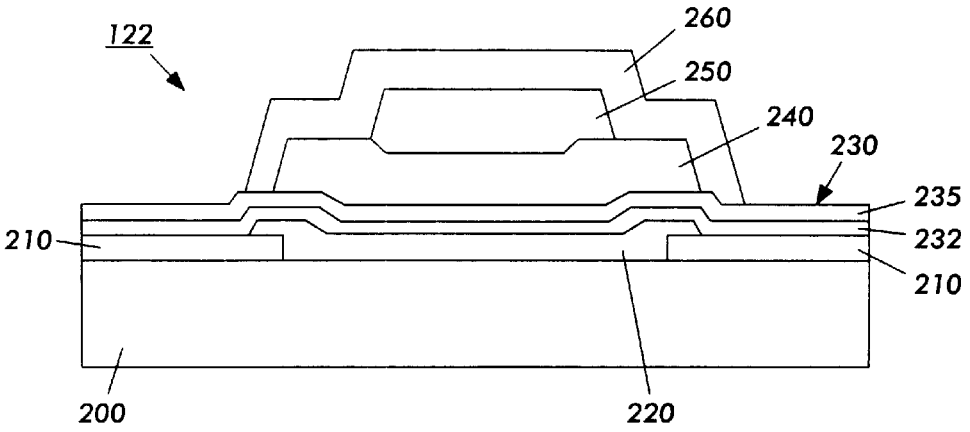
FIG. 3, as shown by cross-section line III—III in FIG. 2, is a cross-sectional view of one exemplary embodiment of a common bus connecting line portion of a low-topography inkjet printhead structure according to this invention.

FIG. 3, as shown by cross-section line III—III in FIG. 2, is a cross-sectional view of the linear connection portion 122 taken across the long axis of the linear connection portion 122. As shown in FIG. 3, a field oxide layer 200 forms at least a portion of the heater plate 102. A relatively lightly-doped ($N^+$) layer 210 is formed on or over the field oxide layer 200. In the region of the linear portion 122 of the connection portion 120, the relatively lightly-doped polysilicon layer 210 is patterned to form a plurality of the resistive heaters. A first insulative layer 220 is formed and patterned to act as an insulative layer between adjacent resistive heater portions of the patterned polysilicon layer 210 and a protective layer 230 formed on or over the insulative layer 220 and the relatively lightly-doped polysilicon layer 210.

As shown in FIG. 3, in various exemplary embodiments, the protective layer 230 is a multi-layer protective layer 230. In various exemplary embodiments, the multi-layer protective layer 230 comprises a pair of layers. In particular, the multilayer protective layer 230 comprises a lower silicon nitride 232 layer formed using a chemical vapor deposition process and an upper beta-phase tantalum layer 235.

In various exemplary embodiments, the multi-layer protective layer 230 should overlap the first insulative layer 220 by approximately 2 $\mu$m to reduce the likelihood that, outside of the ink channel, the beta phase tantalum layer 235 does not terminate on the polysilicon layers 220, described above, and 270, described below. Otherwise, if the tantalum layer 235 terminates in electrical contact with one of the polysilicon layers 220 or 270, the polysilicon becomes damaged near the edge of the tantalum layer 235 and unacceptably low polysilicon-tantalum breakdown voltages occur.

The protective layer 230 is used both to protect against the cavitation forces generated within the ink channel 20 as vapor bubbles of the ink form and collapse within the ink channel 20 to eject ink drops from the ejector structures 110, and to provide electrical isolation between the polysilicon heater structure 210, which is held at the drive voltage, and the ink 24 in contact with the tantalum layer 235.

It should be appreciated that, in other various exemplary embodiments, any other known or later developed protection layer, whether a single layer structure or a multi-layer structure, can be used in place of the multi-layer protective layer 230 described above, so long as that protective layer is able to adequately protect the resistive heater 114 against chemical attack by the ink or by the cavitation forces and/or thermal forces generated by the ink bubbles as they form and collapse within the ink channels 20. It should also be appreciated that the protection structure outside of the ink channels 20, whether the protective layer is the multi-layer protective layer 230 described above or any other known or later developed protective layer, can be patterned away from any regions outside of the ink channels 20. In this case, a separate planarizing layer can be put down in place of the protective layer in order to reduce the topography of the low-topography inkjet printhead structure 100 according to this invention.

A second insulative layer 240 is formed on or over the protective layer 230 and positioned generally vertically over the space formed between the relatively lightly-doped polysilicon layers 210. A conductive metal layer 250 is then formed on or over the second insulative layer 240. An insulative passivation layer 260 is formed on or over the conductive metal layer 250, the second insulative layer 240 and partially over the protective layer 230 to completely encapsulate the second insulation layer 240 and the conductive metal layer 250.

As indicated above, the protective layer 230 is thus only absolutely necessary within the ink channels 20. However, the protective layer 230 is also used outside of the ink channels 20 as an electrical isolation and surface passivation layer in the nozzle 118. That is, in the regions outside the ink channels 20, the protective layer 230 can be utilized to provide electrical, mechanical, and chemical protection to underlying circuit elements of the heater wafer 102 without adding additional topographical structures above the top surface plane of the resistive heater 114 formed by the top surface of the protective layer 230. In contrast, using the second insulating layer 240 or the passivation layer 260 for these purposes, as is generally done in prior art devices, would generate undesirable additional topographical structures.

In various exemplary embodiments, the field oxide layer 200 acts as an electrical and thermal insulation layer and is approximately 1.5 $\mu$m thick. In various exemplary embodiments, the field oxide layer 200 is formed using a thermal steam oxide process. In various exemplary embodiments, the relatively lightly-doped polysilicon layer 210 is approximately 4500 Å thick and is formed using any appropriate chemical vapor deposition or physical vapor deposition process. The first insulative layer 220, in various exemplary embodiments, includes a silicon oxide layer approximately 1,000 Å thick and a 7,000 Å thick doped glass layer. In various exemplary embodiments, the silicon oxide layer is formed using a thermal dry-oxygen process, while the doped glass layer is formed using a low-pressure chemical vapor deposition process with a subsequent oxygen high-temperature reflow process. In particular, in various exemplary embodiments, this doped glass layer has a phosphorous (P) content of approximately 7.2 percent by weight.

The multi-layer protective layer 230, in various exemplary embodiments, has a lower silicon nitride layer 232 and an upper tantalum layer 235. The silicon nitride layer 232 is formed using a pyrolytic low-pressure chemical vapor deposition process and is approximately 1500 Å thick. The tantalum layer 235 is approximately 2500 Å thick. The tantalum layer 235 is deposited as beta-phase tantalum and is formed by sputtering. The second insulative layer 240, in various exemplary embodiments, includes a silicon oxide layer that is approximately 1.0 $\mu$m thick and formed using a plasma-enhanced chemical vapor deposition process and a TEOS (tetra-ethyl-ortho-silicate) precursor.

The conductive metal layer is approximately 1.25 $\mu$m thick. In various exemplary embodiments, the conductive metal layer 250 is an aluminum-silicon alloy having 1 percent by weight silicon and is formed by sputtering. Prior to depositing the conductive metal layer 250, the exposed surfaces of the various layers are etched using an radio frequency sputter etch process to clean the exposed silicon surfaces to improve the contact resistance of the conductive metal layer 250. The passivation layer 260 is, in various exemplary embodiments, approximately 1500 Å thick and is formed using plasma enhanced chemical vapor deposition using a TEOS (tetra-ethylortho-silicate) precursor. The passivation layer 260 also includes a 1.0 $\mu$m silicon nitride layer formed by plasma-enhanced chemical vapor deposition.

As mentioned above, the protective layer 230 acts as a heater protection layer providing both chemical and mechanical protection to the resistive heater 114 in the ejector structure 110. The passivation layer 260 also acts as a mechanical and chemical protection layer. Because the passivation layer 260 encapsulates the conductive metal layer 250, the passivation layer 260 also provides electrical protection.

It should be appreciated that, while the various layers described above are formed, in various exemplary embodiments, using the various thicknesses and processes described above, that any known or later developed process for forming one of the above-outlined layers can be used so long as it results in a layer having the proper mechanical and/or electrically properties as discussed herein. Thus, while various materials, thicknesses and/or deposition processes have been discussed above with respect to layers 200–260, it should be appreciated that this discussion is illustrative only, and not intended to be limiting of the scope of this invention.

Figure 4:
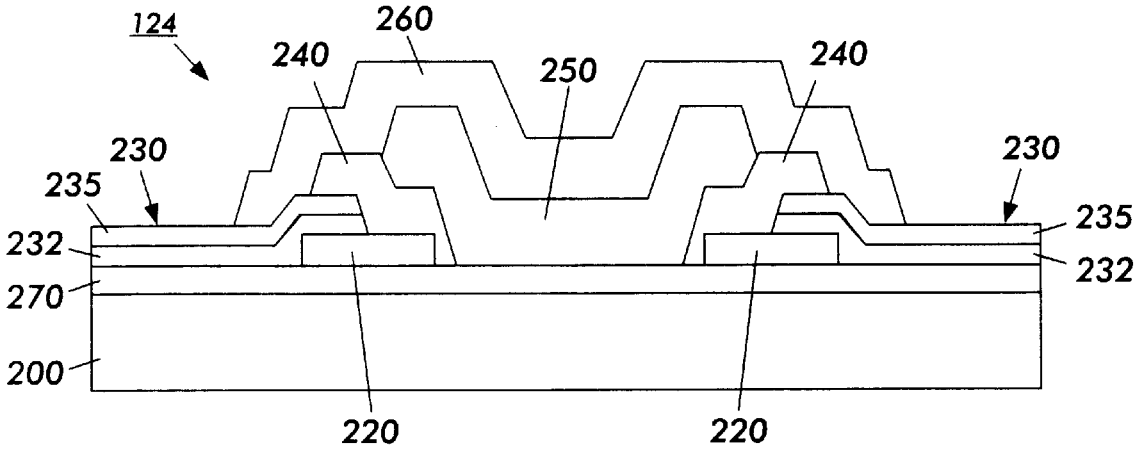
FIG. 4, as shown by the cross-section line IV—IV in FIG. 2, is a cross-sectional view of one exemplary embodiment of a connection structure between the common bus connection line portion and the common bus of the low-topography inkjet printhead structure according to this invention.

FIG. 4, as shown by the cross-section line IV—IV in FIG. 2, is a cross-sectional view illustrating how the conductive metal layer 250 is electrically connected to a relatively highly-doped ($N^{++}$) polysilicon layer 270 forming the common bus structure 130 for the ejector structures 110. As shown in FIG. 4, the relatively highly-doped polysilicon layer 270 is formed on or over the field oxide layer 200 and under the first and second insulation layers 220 and 240 and the protective layer 230. In particular, the conductive metal layer 250 contacts the relatively heavily-doped polysilicon layer 270 either directly or through one or more conductive barrier structures.

Figure 5:
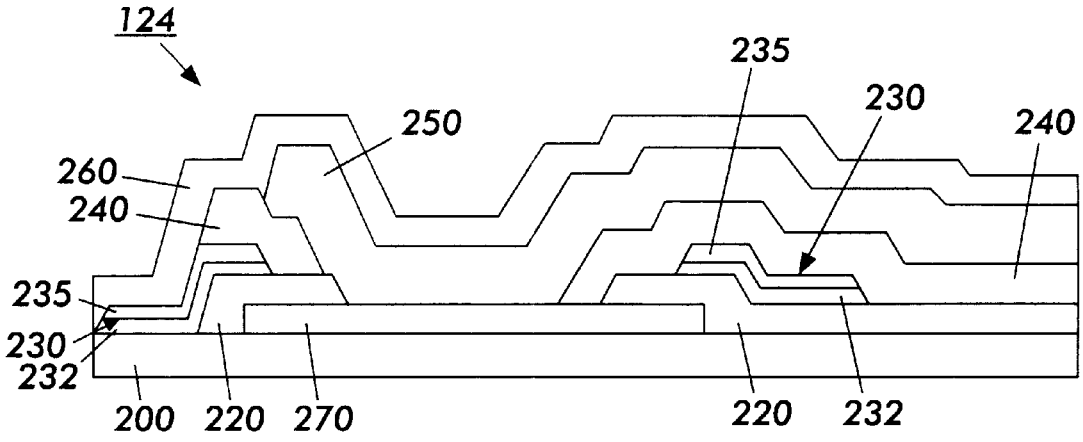
FIG. 5, as shown by the cross-section line V—V in FIG. 2, a second cross-sectional view of the exemplary embodiments of the common bus connection line portion and the common bus shown FIGS. 3 and 4.

FIG. 5, as shown by the cross-section line V—V in FIG. 2, is a cross-sectional view of the common bus connection portion 120 along the long dimension of the common bus connection portion 220, showing both the structure of the common bus connection portion 122 and the contact portion 124.

Figure 6:
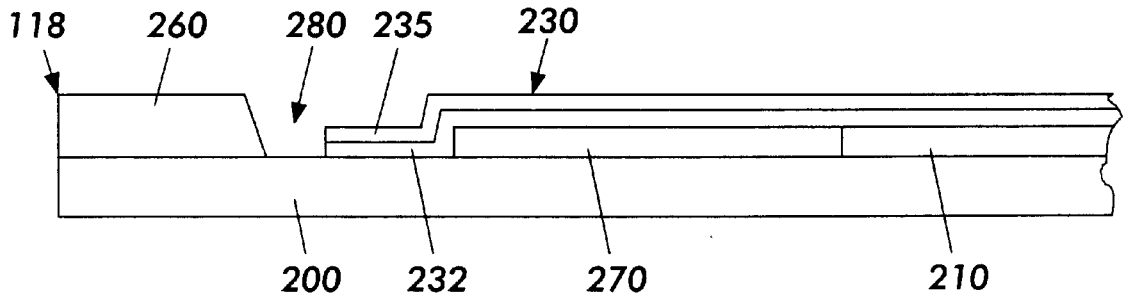
FIG. 6, as shown by the cross-section line VI—VI in FIG. 2, is a cross-sectional view of one exemplary embodiment of a portion of an inkjet drop ejector ink channel of the low-topography inkjet printhead structure according to this invention.

FIG. 6, as shown by the cross-section line VI—VI in FIG. 2, is a cross-sectional view along the long axis of the resistive heater 114 and extending through the nozzle 118. As shown in FIG. 6, the common bus portion 130, formed by the relatively heavily-doped polysilicon layer 270, and the resistive heater portion 114, formed by the relatively lightly-doped polysilicon layer 210, are positioned laterally adjacent to each other to form a conductive path from the drive voltage bus to ground through the common bus connection portion 122, the connection structure 124, the common bus 130, the resistive heater 114 and the address line connection portion 112 to ground. Thus, current flows through the relatively heavily-doped polysilicon layer 270 and into the relatively lightly-doped polysilicon layer 220.

This current flow through the relatively lightly-doped polysilicon layer 210 causes resistive heating in the relatively lightly-doped polysilicon layer 210. In particular, the relatively heavily-doped polysilicon layer 270 has a resistivity that is less than the resistivity of the relatively lightly-doped polysilicon layer 220. In various exemplary embodiments, the resistivity of the relatively heavily-doped polysilicon portion layer is on the order of 20 Ω/□. In contrast, relatively lightly-doped polysilicon layer 210 has a resistivity on the order of 200–3000 Ω/□. In general, the relatively lightly-doped polysilicon layer 210 should have a resistivity that is 1 to 2 orders of magnitude greater that the resistivity of the relatively heavily-doped polysilicon layer 270. This tends to cause most of the resistive heating to occur in the relatively lightly-doped polysilicon layer 220, and relatively little of the resistive heating to occur in the relatively heavily-doped polysilicon layer 270.

In various exemplary embodiments, the polysilicon layers 210 and 270 are doped using phosphorus. Phosphorus is particularly useful because phosphorus reduces roughening of the surface of the polysilicon layers 210 and 270. However, it should be appreciated that any other known or later developed dopant can be used, including arsenic, and even p-type dopants, such as boron.

The heat created by the resistive heating in the relatively lightly-doped polysilicon layer 210 flows through the thermally conductive protective layer 230 and heats the ink in the ink channel 20 sufficiently to cause the ink to vaporize and eject a drop through the nozzle 118.

As shown in FIG. 6, the passivation layer 260 and the protective layer 230 form a generally flat topography. In particular, the connection structure 118 shown in FIG. 1 is moved out of the ejector structure 110 to a portion of the heater plate 102 that is laterally adjacent to the ejector structure 110, as shown in FIG. 2. Thus, while the complex, multi-layer contact structure 124 that is located at the front of the heater plate 102 is required for each ejector structure 110, this complex, multi-layer contact structure 124 avoids introducing any additional topography into the ejector structure 110 and especially avoids ejecting any additional topography into the ejector structure 110 at locations close to the nozzle 118.

In particular, as shown in FIG. 6, the surface of the resistive heater 114 is essentially or substantially flat. It should be appreciated that, to the extent the resistive heater shown in FIG. 6 is not completely flat, a portion of the passivation layer 260 can be added to the ejector structure 110 at a region near the nozzle 118 to remove any residual topography that may be created by the field oxide 200 and the polysilicon layers 210 and 270. It should be appreciated that, in various exemplary embodiments of the ink jet printhead according to this invention, for a given ink formulation, drop size, and/or drop ejection frequency, the most defect-free image formed on the recording medium 40 is obtained when the portion of the passivation layer 260 is provided in the ink channel 20 between the protective layer 230 and the nozzles 22. In contrast, in various other exemplary embodiments of the ink jet printhead according to this invention, for other ink formulations, drop sizes, and/or drop ejection frequencies, the most defect-free image formed on the recording medium 40 is obtained when this portion of the passivation layer 260 is omitted from the ink channel 20.

However, it should be appreciated that, if it is provided in the ink channel 20, this portion of the passivation layer 260 is nonetheless spaced from the protective layer 230 and the relatively heavily-doped polysilicon portion 270, thus forming a valley or divot 280 in the topography of the resistive heater 114. It should be appreciated that this valley or divot 280, in various exemplary embodiments, is approximately 1 μm wide along the resistive heater 114, and, in the various exemplary embodiments, it is approximately 0.5 μm deep. While this valley or divot 280 may generate de-minimis disturbances in the flow of ink through the nozzles 118, removing this valley or divot 280 by attempting to butt the passivation layer 260 directly up against the protective layer 230 and the relatively heavily-doped polysilicon portion 270 tends to create a ridge that extends into the ink channel 20 and thus creates exactly the type of bump-shaped obstacle in the ink channel 10 that this invention was directed to reduce.

In particular, referring back to FIG. 1, the ink channel 20 has a height $h_1$ that is, in various exemplary embodiments, on the order of 20 μm. In contrast, the bump-shaped connection structure 18 has a height $h_2$ that is approximately 7 μm. Thus, the bump-shaped connection structure 18 has a height that is one-third or more of the height of the ink channel 20 itself In contrast, the valley or divot 280, which has a depth of approximately 0.5 μm, is only 2.5% of the height $h_1$ of the ink channel 10. Even if the portion of the passivation layer 260 is emitted at the front of the ink channel 20 near the nozzle 22, the topography encountered by ink flowing from the protection layer 230 through the nozzle 22 is only a small 0.5 μm drop on to a smooth nozzle floor, as opposed to the large 7 μm constriction in a 20 μm nozzle present in the conventional ink channel.

Thus, by making the portion of the ejector structure 110 formed on the heater plate 102 more or less coplanar from the portion of the resistive heater 114 adjacent the address line connection portion 112 through to the nozzle 118, the topographical features in the conventional thermal inkjet printhead that contribute to main and satellite drop misdirection are reduced, if not minimized or even fully eliminated.

It should also be appreciated that the relatively complex multi-layer contact structure 124 shown in FIGS. 4 and 5 provides a good, low-resistance electrical connection between the drive voltage bus and the common bus 130.

It should be appreciated that additional complexity in the multi-layer contact structure shown in FIGS. 4 and 5 arises because the tantalum layer 235 should not be allowed to make electrical contact with either the high voltage drive power supply or to ground. That is, the protective layer 230 should be electrically floating. In particular, if the tantalum layer 235 is inadvertently connected to the 40V drive voltage, the ink can electrolyze and known print defects associated with electrolyzed ink will occur. In contrast, if the tantalum layer 235 is inadvertently connected to ground, high electric fields will be induced that will eventually result in failure of the resistive heaters in the regions of these high electric fields.

It should be appreciated that, in the various exemplary embodiments outlined above, the various exemplary materials and thicknesses of the various exemplary layers have been particularly selected to improve the chemical resistance against the ink and to improve the ability of the various electrical connection structures to operate at voltage levels up to 50 volts.

It should be appreciated that the thermal inkjet printer having the ejection structure 110 and connection structure 124 described above can be used in any known or later developed image forming device, such as a copier, a printer, a facsimile machine, or the like. It should be appreciated that the low-topography thermal inkjet printhead drop ejector structure 100 according to this invention allows the ejector structures to be packed at a high density without introducing topographical features that are detrimental to print quality. At the same time, the low-topography thermal inkjet printhead drop ejector structures 100 according to this invention does not compromise the resistance in the drop ejectors to the corrosive operating environment of a thermal inkjet printer. Finally, it should be appreciated that the low-topography thermal inkjet printhead drop ejectors structure 100 according to this invention reduce voltage variations that can occur from one end of the ejector array to the other end of the ejector array, which tend to introduce variations in ink drop size from one end of the array to the other.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A thermal inkjet printhead, comprising:

an ink channel portion including a resistive heater and terminating in a nozzle;

a common bus electrically connected to the resistive heater and having a resistivity that is lower than a resistivity of the resistive heater, the common bus positioned between the resistive heater and the nozzle;

a connection line that is laterally adjacent to the ink channel portion and that extends approximately perpendicular to the common bus; and a connection structure, including at least one additional layer, that connects the connection line and the common bus, the connection structure positioned laterally adjacent to, and outside of, the ink channel.

2. The thermal inkjet printhead of claim 1, wherein the connection line comprises:

a field oxide layer;

a doped polysilicon layer formed over the field oxide layer;

at least a first insulation layer formed over the field oxide layer and the doped polysilicon layer;

a conductive metal layer formed over at least the first insulation layer; and a passivation layer formed over the conductive metal layer and at least the first insulation layer.

3. The thermal inkjet printhead of claim 2, wherein the at least first insulation layer comprises:

a first insulation layer formed between adjacent patterned areas of the doped polysilicon layer and formed over the field oxide layer and the doped polysilicon layer;

a protective layer formed over the first insulation layer and the doped polysilicon layer; and a second insulation layer formed over the protective layer, wherein the conductive metal layer is formed over the second insulation layer and the passivation layer is formed over the conductive metal layer, the second insulation layer and the protective layer.

4. The thermal inkjet printhead of claim 3, wherein the protective layer comprises:

a silicon nitride layer formed over the first insulation layer and the doped polysilicon layer; and a beta-phase tantalum layer formed over the silicon nitride layer.

5. The thermal inkjet printhead of claim 1, wherein the connection structure comprises:

a field oxide layer;

a doped polysilicon layer formed over the field oxide layer;

a conductive metal layer electrically connected to the doped polysilicon layer; and a passivation layer formed over the conductive metal layer and the doped polysilicon layer.

6. The thermal inkjet printhead of claim 5, further comprising:

at least one insulation layer formed between the doped polysilicon layer and the passivation layer.

7. The thermal inkjet printhead of claim 6, further comprising:

a protective layer; and a second insulation layer, wherein the first insulation layer is formed over the doped polysilicon layer, the protective layer is formed over the first insulation layer and the doped polysilicon layer, the second insulation layer is formed over the doped polysilicon layer, the first insulation layer and the protective layer, the conductive metal layer is formed over the doped polysilicon layer and the second insulation layer, and the passivation layer is formed over the conductive metal layer, the second insulation layer and the protective layer.

8. The thermal inkjet printhead of claim 7, wherein the protective layer comprises:

a silicon nitride layer formed over the doped polysilicon layer and the first insulation layer; and a beta-phase tantalum layer formed over the silicon nitride layer.

9. The thermal inkjet printhead of claim 1, wherein the ink channel comprises:

a field oxide layer;

a relatively lightly-doped polysilicon layer forming the resistive heater and formed over the field oxide layer;

a relatively heavily-doped polysilicon layer formed over the field oxide layer and positioned adjacent to and in electrical contact with the relatively lightly-doped polysilicon layer, the relatively heavily-doped polysilicon layer forming a common bus;

a protective layer formed over the relatively lightly-doped polysilicon layer, the relatively heavily-doped polysilicon layer and the field oxide layer and forming a substantially flat surface; and a passivation layer formed over the field oxide layer in a nozzle portion of the ink channel, the passivation layer being substantially co-planar with the substantially flat surface of the protective layer.

10. The thermal inkjet printhead of claim 9, further comprising a valley formed between the passivation layer and the protective layer, the valley having a depth and a width that does not substantially negatively affect ink flow through the ink channel as ink droplets are ejected from the ink channel.

11. The thermal inkjet printhead of claim 1, wherein the ink channel comprises:

a field oxide layer;

a thin-film resistor forming the resistive heater and formed over the field oxide layer;

a doped polysilicon layer formed over the field oxide layer and positioned adjacent to and in electrical contact with the thin-film resistor, the doped polysilicon layer forming a common bus;

a protective layer formed over the thin-film resistor, the doped polysilicon layer and the field oxide layer and forming a substantially flat surface; and a passivation layer formed over the field oxide layer in a nozzle portion of the ink channel, the passivation layer being substantially co-planar with the substantially flat surface of the protective layer.

12. The thermal inkjet printhead of claim 11, further comprising a valley formed between the passivation layer and the protective layer, the valley having a depth and a width that does not substantially negatively affect ink flow through the ink channel as ink droplets are ejected from the ink channel.

13. A thermal inkjet printhead, comprising:

a channel plate;

a heater plate positioned adjacent to the channel plate to form at least one ink channel between the heater and the channel plates, each ink channel terminating in a nozzle through which ink droplets are ejected from the ink channel, the heater plate comprising:

for each ink channel, a resistive heater formed in that ink channel;

a common bus layer extending through each ink channel and, in each ink channel, in electrical contact with the resistive heater formed in that ink channel;

a protective layer formed over the resistive heater and the common bus layer; and within each ink channel, a portion of a passivation layer positioned adjacent to the common bus layer and the protective layer such that a topography of the heater plate within that ink channel is substantially flat.

14. A thermal inkjet printhead, comprising:

a channel plate;

a heater plate positioned adjacent to the channel plate to form at least one ink channel between the heater and the channel plates, each ink channel terminating in a nozzle through which ink droplets are ejected from the ink channel, the heater plate comprising:

for each ink channel, a resistive heater formed in that ink channel;

a common bus layer extending through each ink channel and, in each ink channel, in electrical contact with the resistive heater formed in that ink channel;

a protective layer formed over the resistive heater and the common bus layer; and within each ink channel, a portion of a passivation layer positioned adjacent to the common bus layer and the protective layer such that asymmetries within that ink channel upstream of the nozzle of that ink channel are reduced. comprises a polysilicon layer.

15. A thermal inkjet printhead, comprising:

an ink channel portion including a resistive heater, the ink channel terminating in a nozzle;

a common bus layer electrically connected to the resistive heater and having a resistivity that is lower than a resistivity of the resistive heater, the common bus positioned between the resistive heater and the nozzle within the ink channel;

an insulative layer formed over the common bus layer outside of the ink channel;

a protective layer formed over the resistive heater, the insulative layer and the common bus layer; and a connection line that is laterally adjacent to the ink channel portion and that extends approximately perpendicular to the common bus layer, the connection line extending over the common bus layer and the protective layer and electrically connected to a top surface of the common bus layer through the protective layer and the insulative layer;

wherein edges of the protective layer over the common bus layer outside of the ink channel terminate over the insulative layer and do not contact the common bus layer.

16. The thermal inkjet printhead of claim 15, wherein the protective layer comprises:

a silicon nitride layer formed over the first insulation layer and the doped polysilicon layer; and a beta-phase tantalum layer formed over the silicon nitride layer.

17. The thermal inkjet printhead of claim 15, wherein the restrictive heater comprises a polysilicon layer.

18. The thermal inkjet printhead of claim 17, wherein the polysilicon layer comprises a doped polysilicon layer.

19. The thermal inkjet printhead of claim 15, wherein the resistive heater comprises a thin film resistor.

20. The thermal inkjet printhead of claim 19, wherein the thin film resistor comprises a sputtered thin-film resistor.

* * * * *